US010760857B2

(12) United States Patent
Bosscher

(10) Patent No.: US 10,760,857 B2
(45) Date of Patent: Sep. 1, 2020

(54) TUBE FOR A HEAT EXCHANGER WITH AN AT LEAST PARTIALLY VARIABLE CROSS-SECTION, AND HEAT EXCHANGER EQUIPPED THEREWITH

(71) Applicant: Intergas Heating Assets B.V., Coevorden (NL)

(72) Inventor: Harm Bosscher, Meppel (NL)

(73) Assignee: Intergas Heating Assets B.V., Coevorden (NL)

( * ) Notice: Subject to any disclaimer, the term of this patent is extended or adjusted under 35 U.S.C. 154(b) by 458 days.

(21) Appl. No.: 15/026,303

(22) PCT Filed: Oct. 1, 2014

(86) PCT No.: PCT/NL2014/050674
§ 371 (c)(1),
(2) Date: Mar. 31, 2016

(87) PCT Pub. No.: WO2015/050441
PCT Pub. Date: Apr. 9, 2015

(65) Prior Publication Data

US 2016/0245598 A1 Aug. 25, 2016

(30) Foreign Application Priority Data

Oct. 2, 2013 (NL) ..... 2011539

(51) Int. Cl.
*F24F 13/08* (2006.01)
*F24H 1/28* (2006.01)
(Continued)

(52) U.S. Cl.
CPC ..... *F28F 13/08* (2013.01); *F24H 1/28* (2013.01); *F24H 1/36* (2013.01); *F28D 1/05366* (2013.01); *F28F 1/025* (2013.01); *F28F 1/06* (2013.01)

(58) Field of Classification Search
CPC ..... F28F 13/08; F28F 1/06
(Continued)

(56) References Cited

U.S. PATENT DOCUMENTS 1,170,834 A 2/1916 Lovekin
2,018,163 A 10/1935 Wells
(Continued)

FOREIGN PATENT DOCUMENTS

AT 105152 B 1/1927
EP 2345844 A2 7/2011
(Continued)

OTHER PUBLICATIONS

Manual of Modern Hydronics, Second Edition, Ipex, 2004, p. 9.*
(Continued)

*Primary Examiner* — Edelmira Bosques
*Assistant Examiner* — Phillip Decker
(74) *Attorney, Agent, or Firm* — Banner & Witcoff, Ltd.

(57) ABSTRACT

The present invention relates to a tube for a heat exchanger, wherein at least a part of the tube has a variable cross-section in longitudinal direction, wherein a cross-sectional area decreases from a maximum value close to an outer end of the tube to a minimum value close to an opposite outer end thereof.

The invention further relates to a heat exchanger provided with at least one such tube and to a central heating installation and a tap water system comprising such a heat exchanger.

16 Claims, 2 Drawing Sheets

(51) Int. Cl.

| | |
|---|---|
| ***F28F 13/08*** | (2006.01) |
| ***F28F 1/02*** | (2006.01) |
| ***F28F 1/06*** | (2006.01) |
| ***F24H 1/36*** | (2006.01) |
| ***F28D 1/053*** | (2006.01) |

(58) Field of Classification Search
USPC ..... 237/57
See application file for complete search history.

(56) References Cited

U.S. PATENT DOCUMENTS

| | | | | | |
|---|---|---|---|---|---|
| 2,181,927 | A * | 12/1939 | Townsend | F28F 1/02 | 165/147 |
| 2,365,688 | A * | 12/1944 | Dewey | F28F 1/06 | 165/158 |
| 3,530,923 | A * | 9/1970 | Mattern | B01D 1/065 | 138/177 |
| 3,724,523 | A | 4/1973 | Mattern | | |
| 3,749,155 | A * | 7/1973 | Buffiere | F25J 5/002 | 138/38 |
| 4,135,567 | A * | 1/1979 | Mattern | B01D 1/06 | 159/16.3 |
| 4,369,837 | A * | 1/1983 | Moranne | B21D 41/04 | 165/175 |
| 4,692,979 | A * | 9/1987 | Pietzcker | B21D 53/085 | 29/726 |
| 4,697,635 | A * | 10/1987 | Longsworth | F25B 9/02 | 165/147 |
| 4,785,879 | A * | 11/1988 | Longsworth | F25B 9/02 | 165/147 |
| 4,946,098 | A * | 8/1990 | Prevot | F24H 1/52 | 165/143 |
| 5,094,224 | A | 3/1992 | Diesch | | |
| 5,333,598 | A * | 8/1994 | Mielke | F24H 3/105 | 126/116 R |
| 5,579,756 | A * | 12/1996 | Jonsson | F24H 1/50 | 126/101 |
| 5,588,399 | A | 12/1996 | Kim | | |
| 5,839,505 | A * | 11/1998 | Ludwig | F28D 1/0477 | 165/109.1 |
| 7,000,572 | B1 | 2/2006 | Schimmeyer | | |
| 8,287,763 | B2 * | 10/2012 | Pham | C01B 3/382 | 252/373 |
| 8,402,927 | B2 * | 3/2013 | Home | F24H 1/282 | 122/15.1 |
| 2002/0005275 | A1 | 1/2002 | O'Donnell et al. | | |
| 2004/0069295 | A1 * | 4/2004 | Rigamonti | F24H 3/087 | 126/109 |
| 2007/0289718 | A1 * | 12/2007 | McCordic | F28F 13/08 | 165/80.4 |
| 2011/0146594 | A1 * | 6/2011 | Smelcer | F24H 1/287 | 122/18.3 |
| 2011/0174291 | A1 * | 7/2011 | Manohar | F23C 3/002 | 126/112 |

FOREIGN PATENT DOCUMENTS

| | | | | |
|---|---|---|---|---|
| FR | 2842587 | A1 * | 1/2004 | F28F 13/08 |
| GB | 2118708 | A | 11/1983 | |
| JP | S4626961 | Y1 | 9/1971 | |
| JP | S4716038 | Y1 | 6/1972 | |
| JP | 2001-027157 | A | 1/2001 | |
| JP | 2003161451 | A | 6/2003 | |
| JP | 2005291581 | A | 10/2005 | |
| RU | 2013747 | C1 | 5/1994 | |
| SU | 1765672 | A1 | 9/1992 | |
| UA | 26682 | U | 10/2007 | |

OTHER PUBLICATIONS

Yoshihiro et al, JP 2003-161451 A English machine translation, Jun. 6, 2003 (Year: 2003).*

International Search Report and Written Opinion issued in corresponding International Application No. PCT/NL2014/050674, dated Jan. 29, 2015.

* cited by examiner

TUBE FOR A HEAT EXCHANGER WITH AN AT LEAST PARTIALLY VARIABLE CROSS-SECTION, AND HEAT EXCHANGER EQUIPPED THEREWITH

RELATED APPLICATION DATA

This application is a National Stage Application under 35 U.S.C. 371 of co-pending PCT application PCT/NL2014/050674 designating the United States and filed Oct. 1, 2014; which claims the benefit of Dutch patent application number 2011539 and filed Oct. 2, 2013, each of which are hereby incorporated by reference in their entireties.

FIELD OF THE INVENTION

The invention relates to a tube for a heat exchanger, wherein at least a part of the tube has a variable cross-section in longitudinal direction.

BACKGROUND

Such a heat exchanger tube is known, for instance from EP 1 429 085. Said document EP 1 429 085 describes a heat exchanger with a number of parallel tubes. The cross-section of each tube goes from being round close to a first outer end attached to a mounting plate to being elliptical in a central part. From there the cross-section changes again to a round shape at the second outer end, which is likewise attached to a mounting plate. The round cross-sectional shape at the ends is chosen here for a simple mounting in round openings in the plates.

SUMMARY

The invention now has for its object to provide a tube for a heat exchanger, the cross-section of which varies in longitudinal direction of the tube such that an optimum heat transfer is possible from a medium flowing through the tube to a medium surrounding the tube. According to the invention this is achieved in the case of such a tube in that a cross-sectional area decreases from a maximum value close to an outer end of the tube to a minimum value close to an opposite outer end thereof. Decreasing the area of the tube achieves that the velocity of the medium flowing through the tube increases, whereby the heat transfer is optimized.

The ratio of the cross-sectional area and the periphery varies along the length of the tube. Optimal flow conditions for the medium can thus be set in the tube.

A ratio of the periphery and the area of the cross-section can advantageously increase here from a minimum value close to an outer end of the tube to a maximum value close to an opposite outer end thereof. This ratio determines the wall area available per unit of the tube for the heat-exchanging contact between the media in and round the tube.

In a preferred embodiment of the tube the ratio of the periphery and the area of the cross-section increases in the direction of the tube in which the cross-sectional area decreases. The velocity and the turbulence of the medium thus increases, whereby the heat transfer is improved.

Although it is possible to envisage the cross-section of the tube being substantially round close to the one outer end and having a flat shape close to the other outer end, a further advantageous embodiment is obtained when the peripheral shape close to the one outer end is substantially round and substantially star-shaped close to the other outer end. In the case of a round cross-section the ratio of the periphery and the area is minimal, while in the case of a star shape it is conversely relatively large. The star can have three or more points here. A circle has a maximum cross-sectional area relative to the periphery, whereby the heat transfer at the outer end where the tube has a round cross-section can deliberately be limited in order to prevent the tube being heated there to undesirably high temperatures. Conversely, a high heat transfer is on the other hand obtained close to the outer end where the tube has the star-shaped periphery.

A structurally simple solution is obtained when the variation in the area and/or the peripheral shape of the cross-section is achieved by deforming at least a part of a wall of the tube.

It is further recommended that, for each cross-section of the tube, a line is defined enveloping the cross-section, and the envelopes are substantially identical along the length of the tube. The external dimension of the tube thus remains constant along its length, whereby it is easy to place a number of tubes adjacently of each other in a heat exchanger.

The variable peripheral shape can in this case be formed by at least one inward folded part of the tube wall. By folding the wall inward the cross-section remains within the constant envelope.

In order to prevent disruption of the flow of the medium in the tube it is recommended that the variation in the area and/or the peripheral shape of the cross-section is substantially gradual. The tube can otherwise also have a part of constant cross-section. Where there is variation however, this variation preferably therefore has a gradual progression.

The invention also relates to a heat exchanger provided with at least one tube for a first medium, which at least one tube is in heat-exchanging contact with a second medium flowing therealong. According to the invention the at least one tube is a tube of the above described type.

For the purpose of a controlled heat transfer the at least one tube is preferably received in a housing in which the second medium flows.

As stated, the variation in the cross-section provides the option of adapting this variation to the temperature gradient in the medium in the tube. This is particularly advantageous when the first medium is a heating medium and the at least one tube is connected to a heat source, while the second medium is a heat-absorbing medium. The temperature of the heating medium can after all be properly controlled by means of the heat source.

The outer end of the at least one tube where the cross-sectional area is maximal and/or the ratio of the periphery and the area of the cross-section has a minimum value is preferably connected to the heat source. This achieves that the heating medium will first flow relatively slowly through the wide part of the tube so that there is sufficient time to transfer the large quantity of heat in the heating medium to the water-absorbing medium around the tube. Once the greater part of the heat has been transferred, the flow of the heating medium can then be accelerated by narrowing the tube.

When the housing has an inflow opening for the second medium formed in or close to a first side and an outflow opening for the second medium formed in or close to a second side, a number of tubes are preferably arranged substantially parallel in the housing and enclose an angle with a line which mutually connects the inflow opening and the outflow opening. Thus formed is a cross-current or cross-flow heat exchanger which is structurally simple, compact and efficient.

The housing with the inflow opening and outflow opening can form part of a circuit in a central heating installation, and the tubes can form part of a flue duct of a heating burner. The heat exchanger can thus be applied in a central heating installation.

The housing with the inflow opening and outflow opening can also form part of a tap water conduit, while the tubes form part of a flue duct of a heating burner. The heat exchanger is then suitable for use in a tap water system.

Finally, the invention further relates to a central heating installation and a tap water system in which a heat exchanger of the above described type is applied. The central heating installation here comprises a heating burner, a circuit which extends along one or more spaces and in which a medium circulates, and a heat exchanger according to the invention mutually connecting the burner and the circuit. In similar manner the tap water system comprises a heating burner, a water conduit extending from a water source to a draw-off point and a heat exchanger mutually connecting the burner and the water conduit.

BRIEF DESCRIPTION OF THE DRAWINGS

The invention will now be elucidated on the basis of two embodiments wherein reference is made to the accompanying drawing in which corresponding parts are designated with the same reference numerals, and in which.

DETAILED DESCRIPTION

Figure 1:
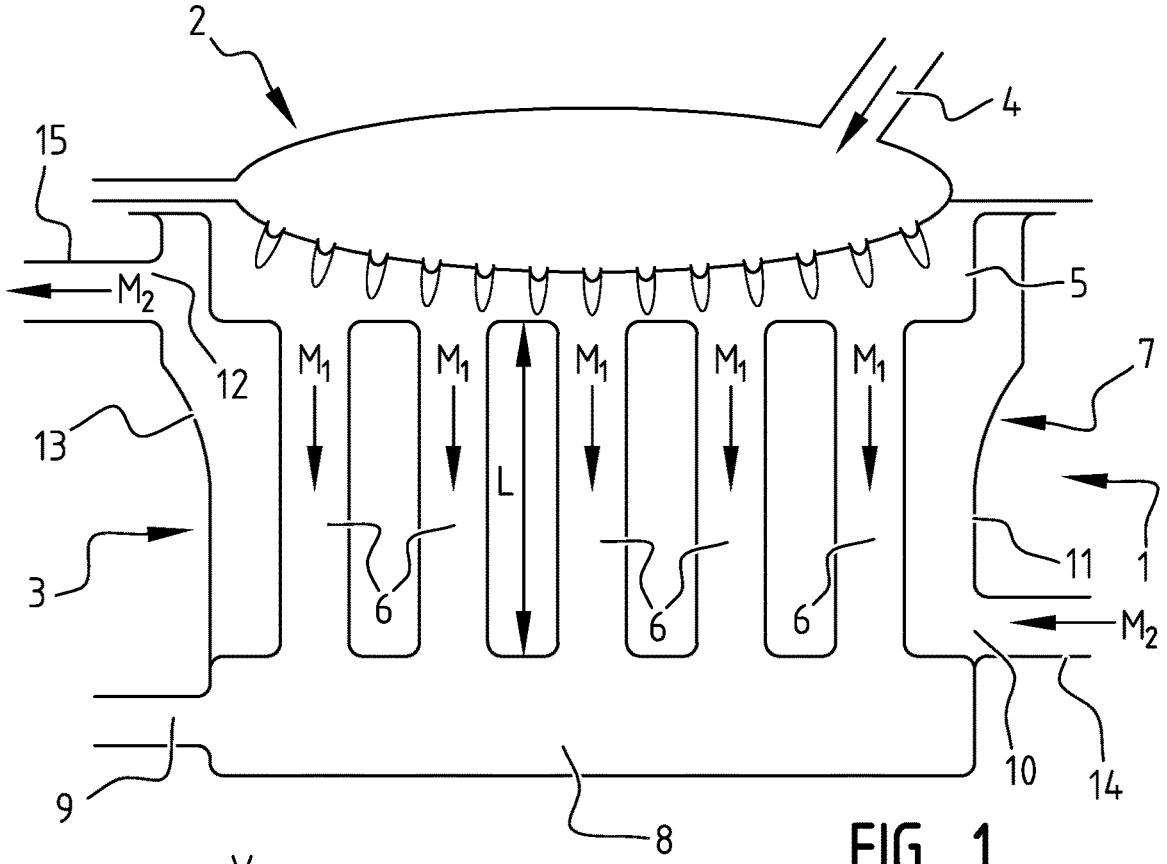
FIG. 1 is a schematic view of a heat exchanger with tubes according to a first embodiment of the invention.
Figure 2:
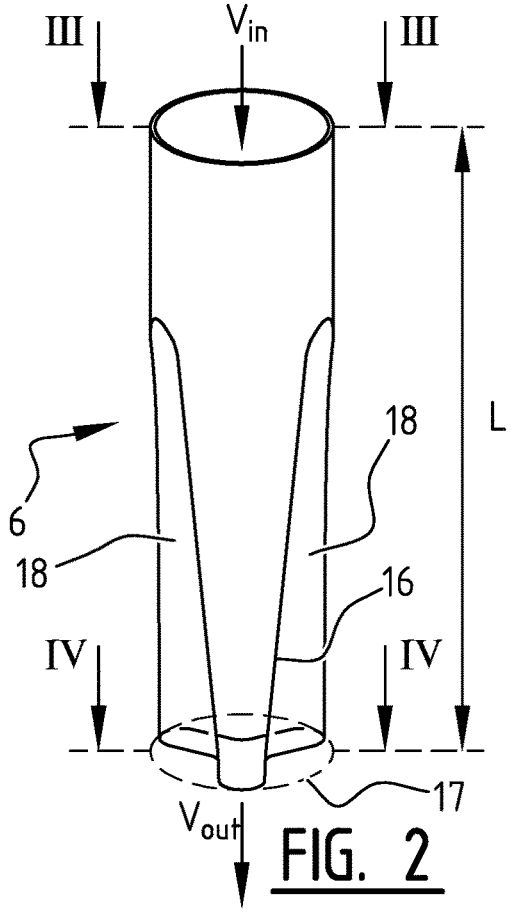
FIG. 2 is a perspective view of a tube for application in the heat exchanger of FIG. 1, with the flow velocities of a medium in the tube.

A central heating (CH) installation 1 (FIG. 1) comprises a heating burner 2 and a circuit (not shown) for a medium M2 which is guided along one or more spaces and there flows through radiators. The medium M2 is heated indirectly by burner 2. Placed for this purpose between the circuit and heating burner 2 is a heat exchanger 3 in which flows a medium M1.

In the shown embodiment the medium M1 is formed by the flue gases released when a combustible mixture C is combusted in burner 2. This combustible mixture C is fed to burner 2 through a conduit 4, while the flue gases leaving burner 2 are in the first instance collected in an outlet manifold 5. From here the flue gases are distributed over a number of parallel tubes 6 arranged in a housing 7 of heat exchanger 3. At an opposite side of housing 7 the tubes 6 debouch into an accumulation chamber 8, from where the flue gases are discharged through an outlet 9.

Housing 7 is further provided with an inflow opening 10 in a side 11 and an outflow opening 12 in an opposite side 13. Inflow opening 10 is connected here to a return conduit 14 of the circuit of CH installation 1, while outflow opening 12 is connected to a feed conduit 15 of the circuit. After passing through the circuit the medium M2, once it has relinquished its heat to the spaces for heating, can thus flow through heat exchanger 3 and be brought there into heat-exchanging contact with the heating medium M1 (the flue gases) flowing through tubes 6. The heated medium M2 can then pass through the circuit again.

Because tubes 6 extend in the shown embodiment at substantially a right angle relative to a line mutually connecting inflow opening 10 and outflow opening 12, the heat exchanger in the shown embodiment is a cross-current or cross-flow heat exchanger.

According to the invention the tubes 6 have a variable cross-section, in any case along a part of their length. In the shown embodiment the variations are limited to the final part of tubes 6 as seen in the flow direction of medium M1. Tubes 6 here have a constant cross-section along the first half of their length L, but the area A and the peripheral shape P of the cross-section then change.

The area A decreases here as seen in flow direction so that the outflow area is smaller than the inflow area: $A_{out}<A_{in}$. The decrease in the area has the result that the flow velocity of medium M1 in tube 6 will increase in order to maintain a constant mass flow: $V_{out}>V_{in}$. Owing to the lower flow velocity in the first part of tube 6 close to burner 2, the residence time of medium M1 in this part of tube 6 is relatively long, whereby the then still very hot medium M1 can transfer a greater amount of heat to medium M2. The residence time decreases as the flow velocity increases as a result of the narrowing of tube 6, whereby less heat will also be transferred.

This effect is compensated in that in the shown embodiment the peripheral shape of tube 6 also changes, this such that the ratio of the periphery P and the area A of the cross-section increases. An increasingly larger wall part 16 of tube 6 hereby becomes available per unit of cross-sectional area A of tube 6 for heat-exchanging contact between the two media M1 and M2 on either side of wall 16.

Figure 4:
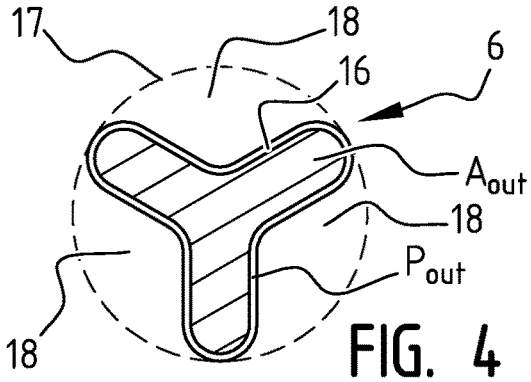
Figure 5:
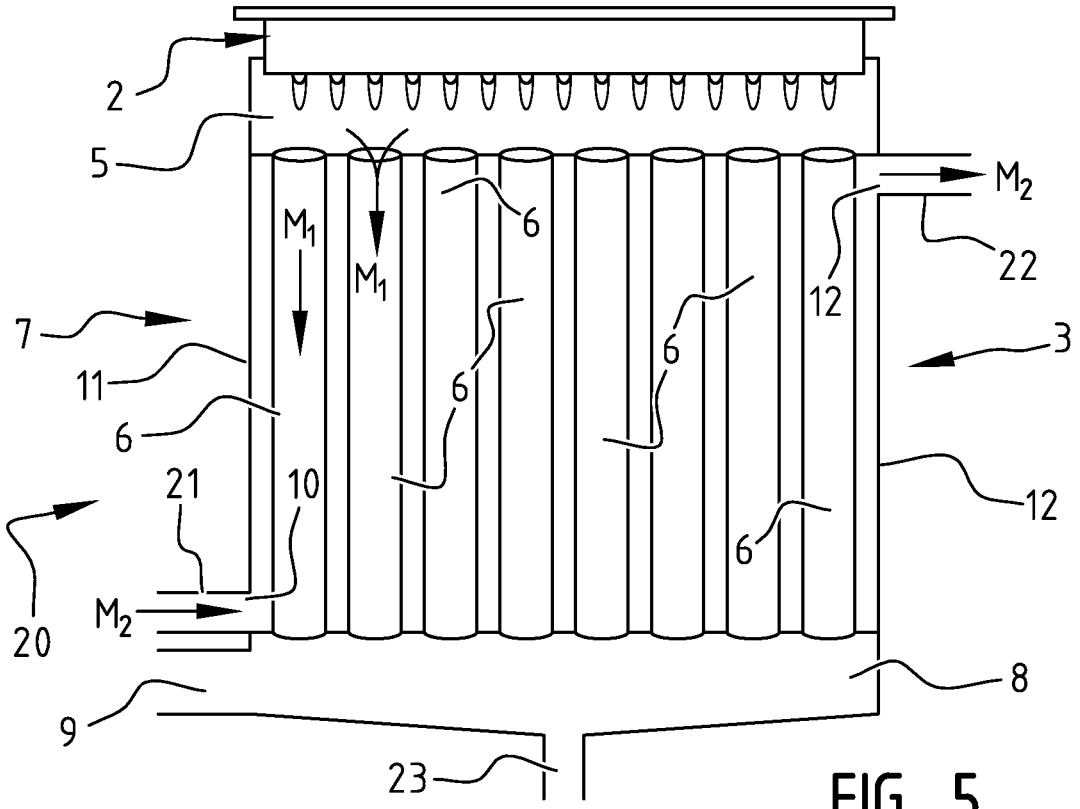
FIG. 5 is a schematic view of a second embodiment of the heat exchanger.
Figure 6:
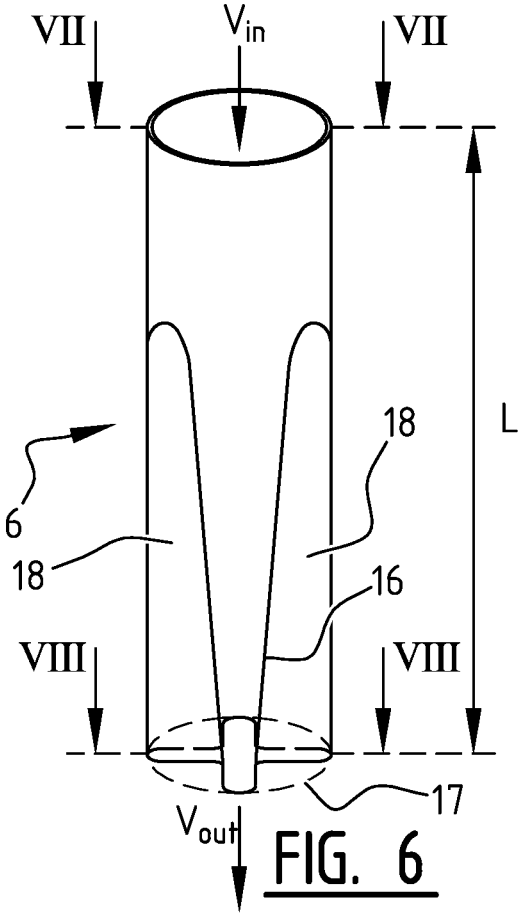
FIG. 6 is a view corresponding to FIG. 2 of the second variant of the tube.
Figure 7:
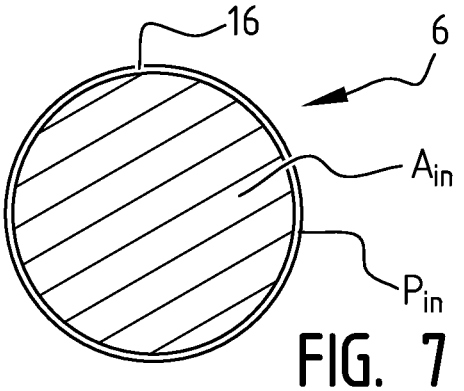
FIGS. 7 and 8 show cross-sections along the respective lines VII-VII and VIII-VIII in FIG. 6.

In the shown embodiment the outer dimension of tube 6 does not vary. The area A fits at any point of tube 6 within the same envelope 17. Tubes 6 can hereby be accommodated in simple manner adjacently of each other with constant spacing in housing 7. The variation in the peripheral shape P and area A of tube 6 is found here within this constant envelope 17. Wall 16 of tube 6 is deformed locally for this purpose. In the shown embodiment wall 16 is folded inward at three locations, whereby three recesses 18 are formed. These recesses 18 increase in depth and width as seen in the flow direction, whereby the sought-after reduction in the area A and the desired increase in periphery P is obtained. The cross-section of tube 6 in this way acquires the form of a three-pointed star with rounded tips (FIG. 4).

Figure 3:
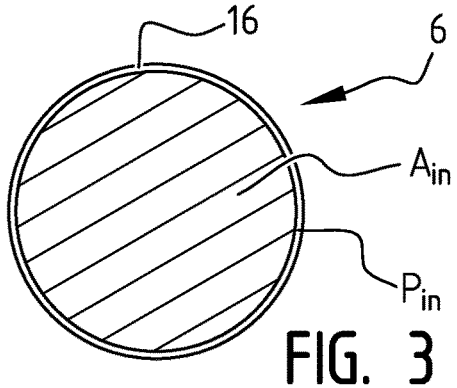
FIGS. 3 and 4 show cross-sections along the respective lines and IV-IV in FIG. 2.

A circle has the smallest ratio of the periphery and the enclosed area. As can be seen from comparing FIGS. 3 and 4, the periphery $P_{out}$ of the "star shape" is considerably longer than that of the circle $P_{in}$. At the same time the area $A_{out}$ enclosed by the star shape is considerably smaller than the area $A_{in}$ enclosed by the circle—the difference being formed by the surface areas of recesses 18. This is of course associated with the fact that the star shape falls within the same envelope 17 as the circle.

The variation in the area A and the peripheral shape P of tube 6 is otherwise gradual so that there is no risk of flow release and turbulence in tube 6. Wall 16 transposes gradually from a cylinder to a folded shape, after which the folds increase uniformly in size.

Figure 8:
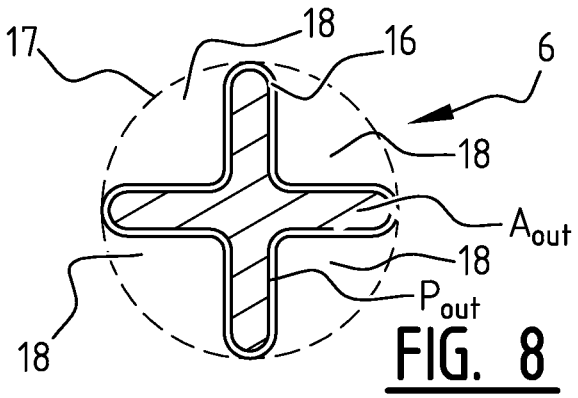

In another embodiment of the invention tubes 6 are provided with four recesses 18 and end in a four-pointed star (FIG. 8). The ratio of the periphery P and area A is hereby even larger because the wall 16 differs more from the circular shape. A greater number of recesses 18 results in a relatively longer periphery P, and so a larger heat-exchanging wall 16.

This embodiment of tube 6 is shown in combination with a heat exchanger 3 for a tap water system 20. Inflow opening 10 of housing 7 is connected here to a conduit 21 which supplies cold water from a water source (not shown), for instance the water mains. This cold tap water is guided as heat-absorbing medium M2 through heat exchanger 3 and brought therein to a desired temperature through contact with the medium M1 (the flue gases) in tubes 6 (of which only some are shown). The heated tap water then leaves the heat exchanger through outflow opening 12 and flows through a conduit 22 to a draw-off point (not shown), for instance a drinking water tap. In this embodiment the tubes 6 once again also lie roughly transversely of the direction in which the medium M2 flows through housing 7 from inflow opening 10 to outflow opening 12.

Further shown in this embodiment is a discharge opening 23 for condensation at the bottom of accumulation chamber 8 for the flue gases. When the flue gases relinquish their heat to the tap water and thereby cool, water vapour present in the flue gases will condense and the condensation will accumulate at the lowest point of heat exchanger 3, so in the shown embodiment on the bottom of accumulation chamber 8. Although not shown, such a condensation discharge can also be present in the first embodiment.

Although the invention has been elucidated above on the basis of two embodiments, it will be apparent that it is not limited thereto but can be varied in many ways. The recesses thus run for instance in axial direction of the tube in the shown embodiments, although it is also possible to envisage them running at an angle to the axial direction, whereby the tube wall acquires something of a twisted appearance. In the shown embodiments the recesses are further distributed uniformly over the periphery of the tube, but this is not essential. Other distributions are also possible. It is also possible to opt for an initial shape of the tubes other than the shown circular shape. The inflow side of the tubes could thus take an elliptical form, optionally even with flattened sides. Non-curved peripheral shapes, such as optionally regular polygons, could also be envisaged. The tubes and heat exchangers equipped therewith can further also be used in applications other than CH installations and tap water systems. The variable cross-section of the tubes in longitudinal direction can also provide advantages in industrial process installations.

The scope of the invention is therefore defined solely by the following claims.

The invention claimed is:

1. A heat exchanger comprising at least one tube for a first medium comprising flue gasses, which at least one tube is in heat-exchanging contact with a second medium flowing therealong, the second medium to be heated by the flue gasses and comprising tap water, wherein at least a part of the tube has a cross-section that varies in a substantially linear manner in a longitudinal direction, and wherein a cross-sectional area decreases from a maximum value proximate a heating burner end of the tube to a minimum value proximate a flue gas exit end thereof, wherein a heating burner is positioned at a top of the heat exchanger, wherein the at least one tube is received in a housing in which the second medium flows, wherein the housing has an inflow opening for the second medium formed in or proximate a first side and an outflow opening for the second medium formed in or proximate a second side, and a number of tubes are arranged substantially parallel in the housing and enclose an angle with a line which mutually connects the inflow opening and the outflow opening; and wherein the housing with the inflow opening and outflow opening forms part of a tap water conduit and the tubes form part of a flue duct of the heating burner.

2. The heat exchanger as claimed in claim 1, wherein a peripheral shape of the cross-section of the at least one tube varies in a longitudinal direction of the tube.

3. The heat exchanger as claimed in claim 2, wherein a ratio of a periphery and the area of the cross-section of the at least one tube increases from a minimum value proximate an outer end of the tube to a maximum value proximate the opposite outer end thereof.

4. The heat exchanger as claimed in claim 3, wherein the ratio of the periphery and the area of the cross-section of the at least one tube increases in the direction of the tube in which the cross-sectional area decreases.

5. The heat exchanger as claimed in claim 3, wherein the peripheral shape proximate the outer end of the at least one tube is substantially round and has a substantially flat form proximate the opposite outer end.

6. The heat exchanger as claimed in claim 3, wherein the peripheral shape proximate the outer end of the at least one tube is substantially round and substantially star-shaped proximate the opposite outer end.

7. The heat exchanger as claimed in claim 2, wherein a variation in the area and/or the peripheral shape of the cross-section of the at least one tube is achieved by deforming at least a part of a wall of the tube.

8. The heat exchanger as claimed in claim 2, wherein a variation in peripheral shape of the cross-section of the at least one tube is substantially linear.

9. The heat exchanger as claimed in claim 1, wherein for each cross-section of the tube a line is defined enveloping the cross-section, and the envelopes have substantially the same length along the length of the tube.

10. The heat exchanger as claimed in claim 1, wherein a variable peripheral shape is formed by at least one inward folded part of the tube wall.

11. The heat exchanger as claimed in claim 1, wherein the first medium is a heating medium and the at least one tube is connected to a heat source, while the second medium is a heat-absorbing medium.

12. The heat exchanger as claimed in claim 11, wherein the outer end of the at least one tube where the cross-sectional area is maximal and/or the ratio of the periphery and the area of the cross-section has a minimum value is connected to the heat source.

13. The heat exchanger as claimed in claim 1, wherein the housing with the inflow opening and outflow opening forms part of a circuit in a central heating installation, and the tubes form part of a flue duct of the heating burner.

14. The heat exchanger as claimed in claim 1, wherein an external dimension of the tube remains substantially constant along its length.

15. A central heating installation, comprising a heating burner, a circuit which extends along one or more spaces and in which a medium circulates, and a heat exchanger provided with at least one tube for a first medium comprising flue gasses, which at least one tube is in heat-exchanging contact with a second medium flowing therealong, the second medium to be heated by the flue gasses and comprising tap water, wherein at least a part of the tube has a cross-section that varies in a substantially linear manner in a longitudinal direction, and wherein a cross-sectional area decreases from a maximum value proximate to a heating burner end of the tube to a minimum value proximate a flue gas exit end thereof, wherein the heating burner is positioned at a top of the heat exchanger, wherein the at least one tube is received in a housing in which the second medium flows, wherein the housing has an inflow opening for the second medium formed in or proximate a first side and an outflow opening for the second medium formed in or proximate a second side, and a number of tubes are arranged substantially parallel in the housing and enclose an angle with a line which mutually connects the inflow opening and the outflow opening; and wherein the housing with the inflow opening and outflow opening forms part of a tap water conduit and the tubes form part of a flue duct of the heating burner, wherein the heat exchanger mutually connects the burner and the circuit.

16. A tap water system, comprising a heating burner, a water conduit extending from a water source to a draw-off point, and a heat exchanger provided with at least one tube for a first medium comprising flue gasses, which at least one tube is in heat-exchanging contact with a second medium flowing therealong, the second medium to be heated by the flue gasses and comprising tap water, wherein at least a part of the tube has a cross-section that varies in a substantially linear manner in a longitudinal direction, and wherein a cross-sectional area decreases from a maximum value proximate a burner end of the tube to a minimum value proximate a flue gas exit end thereof, wherein the heating burner is positioned at a top of the heat exchanger, wherein the at least one tube is received in a housing in which the second medium flows, wherein the housing has an inflow opening for the second medium formed in or proximate a first side and an outflow opening for the second medium formed in or proximate a second side, and a number of tubes are arranged substantially parallel in the housing and enclose an angle with a line which mutually connects the inflow opening and the outflow opening; and wherein the housing with the inflow opening and outflow opening forms part of a tap water conduit and the tubes form part of a flue duct of the heating burner, wherein the heat exchanger mutually connects the burner and the water conduit.

* * * * *